US009568202B2

(12) United States Patent
Majordy et al.

(10) Patent No.: US 9,568,202 B2
(45) Date of Patent: Feb. 14, 2017

(54) PREMIUM PREP TABLE

(75) Inventors: Moe H. Majordy, Parsons, TN (US); Richard A. Seiss, Arlington, TN (US)

(73) Assignee: THE DELFIELD COMPANY, LLC, Mt. Pleasant, MI (US)

( * ) Notice: Subject to any disclaimer, the term of this patent is extended or adjusted under 35 U.S.C. 154(b) by 967 days.

(21) Appl. No.: 13/487,105

(22) Filed: Jun. 1, 2012

(65) Prior Publication Data

US 2012/0309285 A1 Dec. 6, 2012

Related U.S. Application Data

(60) Provisional application No. 61/492,355, filed on Jun. 1, 2011.

(51) Int. Cl.

| | |
|---|---|
| ***A47B 37/00*** | (2006.01) |
| ***F24F 5/00*** | (2006.01) |
| ***A47F 3/04*** | (2006.01) |

(52) U.S. Cl.

CPC ..... *F24F 5/00* (2013.01); *A47F 3/0452* (2013.01); *F24F 2221/10* (2013.01)

(58) Field of Classification Search

CPC ..... F24F 5/00; F24F 2221/10; A47F 3/04; A47F 3/0439; A47F 3/0443; A47F 3/0452; A47F 3/0408; F25D 17/04; F24D 23/12

USPC 454/254, 173, 193, 370; 108/50.13; 62/258, 62/407

See application file for complete search history.

(56) References Cited

U.S. PATENT DOCUMENTS

| | | | | |
|---|---|---|---|---|
| 1,932,694 | A | 10/1933 | Gray | |
| 4,038,968 | A * | 8/1977 | Rovell | A47J 36/26 126/21 A |
| 4,923,086 | A | 5/1990 | Mahon et al. | |
| 5,168,719 | A | 12/1992 | Branz et al. | |
| 5,191,769 | A | 3/1993 | Mangini et al. | |
| 5,263,334 | A | 11/1993 | Kado et al. | |
| 5,355,687 | A | 10/1994 | Carpenter et al. | |
| 5,363,672 | A | 11/1994 | Moore et al. | |
| 5,927,092 | A | 7/1999 | Kushen et al. | |
| 6,000,236 | A * | 12/1999 | Haasis | 62/440 |
| 6,151,905 | A | 11/2000 | Smith | |
| 6,385,990 | B1 | 5/2002 | Lee | |
| 6,434,961 | B2 | 8/2002 | Richmond et al. | |
| 7,028,498 | B2 * | 4/2006 | Monroe et al. | 62/258 |
| 2009/0188275 | A1 | 7/2009 | Lintker et al. | |

OTHER PUBLICATIONS

Extended European Search Report dated Sep. 12, 2014 from corresponding EP Application No. 12792942.0, 7 pages.

International Search Report With Written Opinion Mailed Aug. 24, 2012 in the Corresponding PCT/US12/040580.

International Preliminary Report on Patentability (IPRP) dated Jan. 23, 2014 from corresponding PCT/US2012/040580, pp. 7.

(Continued)

*Primary Examiner* — Gregory Huson
*Assistant Examiner* — Dana Tighe
(74) *Attorney, Agent, or Firm* — Ohlandt, Greeley, Ruggiero & Perle, L.L.P.

(57) ABSTRACT

The present disclosure provides an improved food preparation table. Cooled air is passed over the top of each food pan individually, preventing the food from spoiling at high ambient temperatures. The sides of the food pans are also cooled at the same time.

14 Claims, 6 Drawing Sheets

(56) References Cited

OTHER PUBLICATIONS

International Preliminary Report on Patentability (IPRP) dated Feb. 12, 2014 from corresponding PCT/US2012/040580, pp. 7.
European Communication pursuant to Article 94(3) EPC dated Oct. 1, 2015 from corresponding EP Application No. 12 792 942.0, 4 pages.
Canadian Patent Office action dated Oct. 5, 2015 from corresponding Canadian Patent Application No. 2,837,720, 4 pages.
Office Action dated Dec. 14, 2015 for corresponding Chinese patent application No. 201280033514.6 with English translation, 16 pages.
Patent Examination Report dated Apr. 28, 2015 from corresponding Australian Patent Application No. 2012261878, pp. 3.
Office Action dated Jul. 3, 2015 for corresponding Chinese patent application No. 201280033514.6, pp. 19.
Canadian Patent Office action dated Jun. 28, 2016 from corresponding Canadian Patent Application No. 2,837,720, 4 pages.

* cited by examiner

PREMIUM PREP TABLE

CROSS-REFERENCE TO RELATED APPLICATIONS

The present application claims the benefit of U.S. Provisional Patent Application No. 61/492,355, filed on Jun. 1, 2011, which is incorporated herein by reference.

BACKGROUND OF THE DISCLOSURE

1. Field of the Disclosure

The present disclosure relates to a prep table for storing and cooling food products. More particularly, the present disclosure relates to a prep table with a pressurized chamber that provides enhanced cooling.

2. Description of the Related Art

In the food service industry, prep tables have pans placed therein for storing, displaying, or serving various food products. The pans are cooled by a refrigeration system often located in a compartment below the pans. These prep tables are also sometimes known as open-top refrigerators or pan-top modular units. At high ambient temperatures, for example 86° F. (degrees Fahrenheit) or higher, it can be extremely difficult to maintain the food pans at food-safe temperatures for long, which leads to food spoilage and loss. The present disclosure provides a device that overcomes these shortcomings.

SUMMARY OF THE DISCLOSURE

The present disclosure provides a prep table that comprises a pressurized chamber, cooling module, and food pan. During operation of the prep table, the food pan is placed in the cooling module, which is in turn placed into the pressurized chamber. Cooled air is passed over the top of the food pan, and optionally, the sides of the food pan as well.

In one embodiment, the present disclosure provides a food preparation table. The table comprises: a chamber having side walls, an open top end, a bottom surface, and a hole in the bottom surface, a divider bar covering the open top end of the chamber and sealingly connected to the side walls of the chamber, wherein the divider bar comprises at least one aperture therein; a pan cooling module having a hollow walled structure with an open top end and an open bottom end, wherein the pan cooling module is within the aperture of the divider bar and wherein the bottom end of the pan cooling module covers the hole in the bottom surface of the chamber; and a food pan within the pan cooling module. The open bottom end of the pan cooling module is sealingly connected to the bottom surface of the chamber, and the open top end of the pan cooling module is sealingly connected to the divider bar.

In another embodiment, the present disclosure provides a method of cooling food in a food preparation table, the food preparation table comprising: a chamber having an open top end and a hole in a bottom surface thereof, a pan cooling module having a hollow walled structure with an open top end and an open bottom end, wherein the pan cooling module is within the chamber, and a food pan within the pan cooling module. The method comprising the steps of pressurizing the chamber by introducing cooled air thereto.

DETAILED DESCRIPTION OF THE DISCLOSURE

Figure 1:
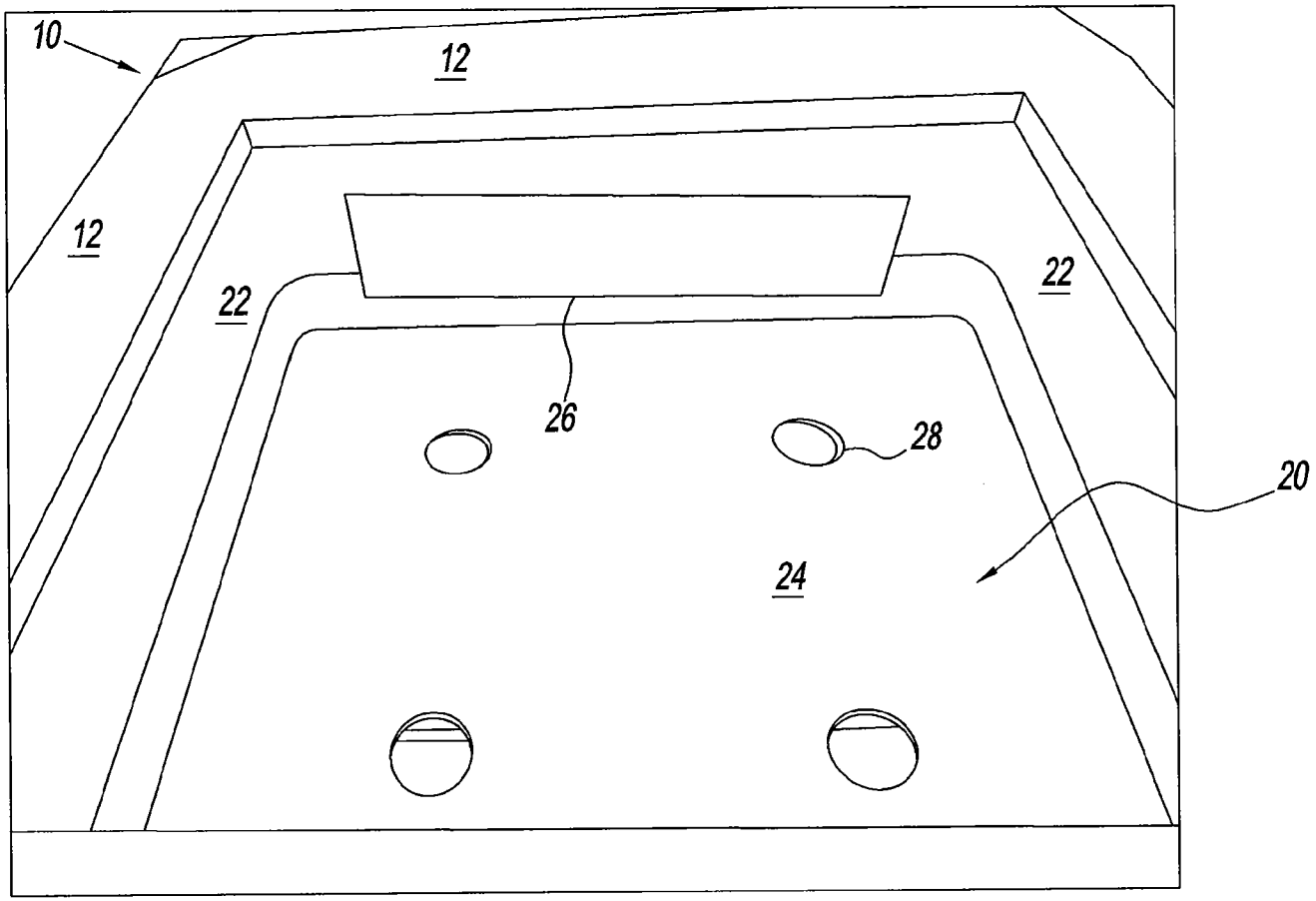
FIG. 1 shows a top perspective view of the chamber of the prep table of the present disclosure.

Referring to FIGS. 1-6, prep table 10 is shown. Prep table 10 has outer edge 12, chamber 20, cooling modules 30, and food pans 40, all of which are designed to provide efficient cooling of products within pans 40, even at high temperatures. As discussed in greater detail below, pans 40 are stored within chamber 20 and cooling modules 30 during use in such a way that chamber 20 becomes pressurized. Cooled air is then passed over both the top of pans 40, and around the sides thereof, to provide cooling, before the cooled air is passed through the bottom of chamber 20 and recycled. This differs from current prep tables in several ways. Some current devices do not cool the tops of pans at all, and only cool the sides or bottom. Some current devices blow air over the tops of pans, but not for each pan individually. This can lead to variances in how well the pans are cooled. The pans nearest the cooling device will receive more cooling than pans further away. Some current devices sink the food pans very deep to remove them from ambient air currents as much as possible, but this can make the food pans hard to remove or service. Prep table 10 addresses all of these disadvantages.

Figure 2:
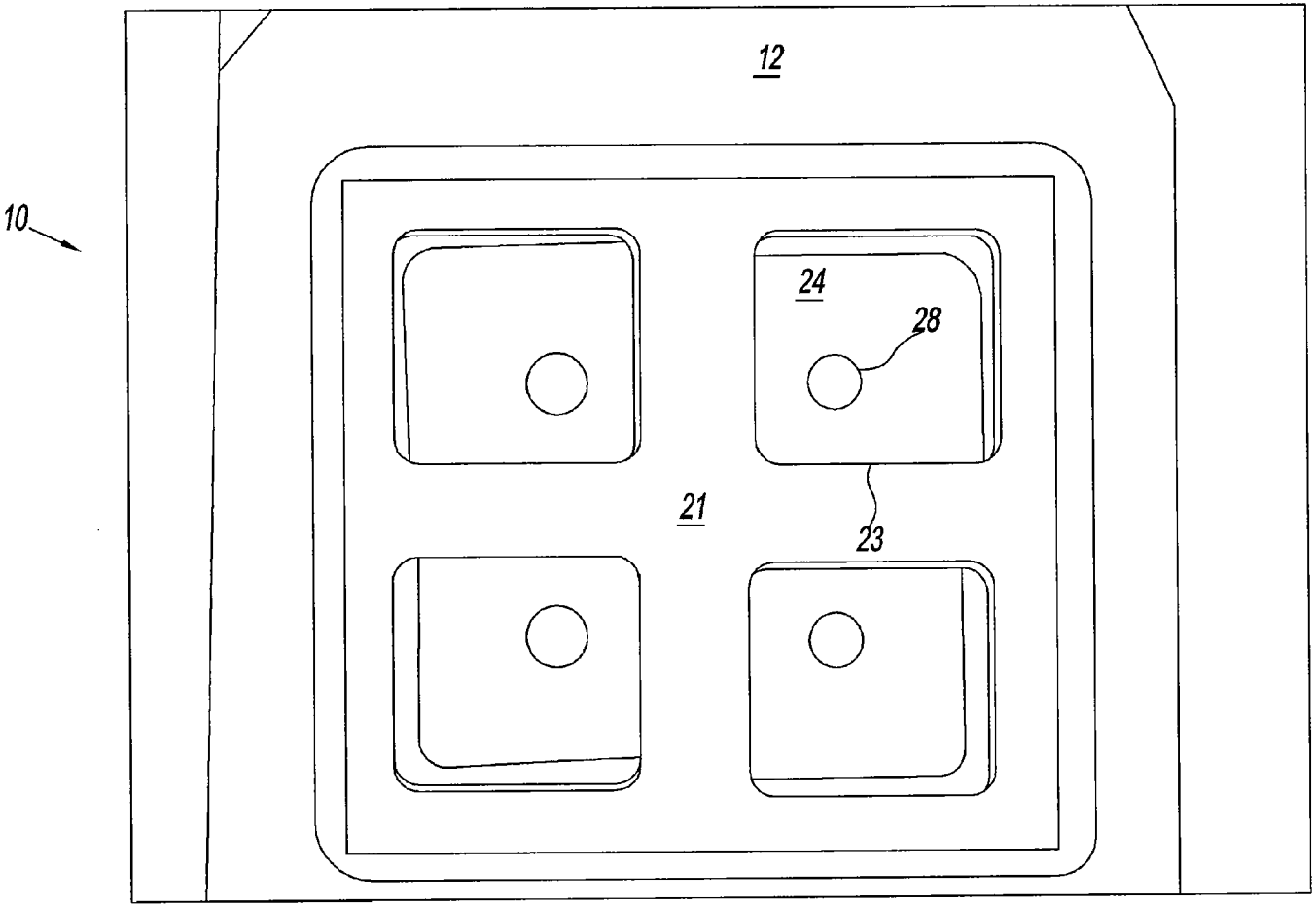
FIG. 2 shows a top view of the chamber of FIG. 1, with a divider bar placed therein.

Referring specifically to FIGS. 1 and 2, chamber 20 has side walls 22, and bottom surface 24. Cooled air is supplied through at least one vent 26. Bottom surface 24 has at least one hole 28 therein for each pan 40 used in prep table 10. As shown in FIG. 2, divider bar 21 is placed over the top of chamber 20, and has one opening 23 for each pan 40. Openings 23 generally align with holes 28.

Figure 3:
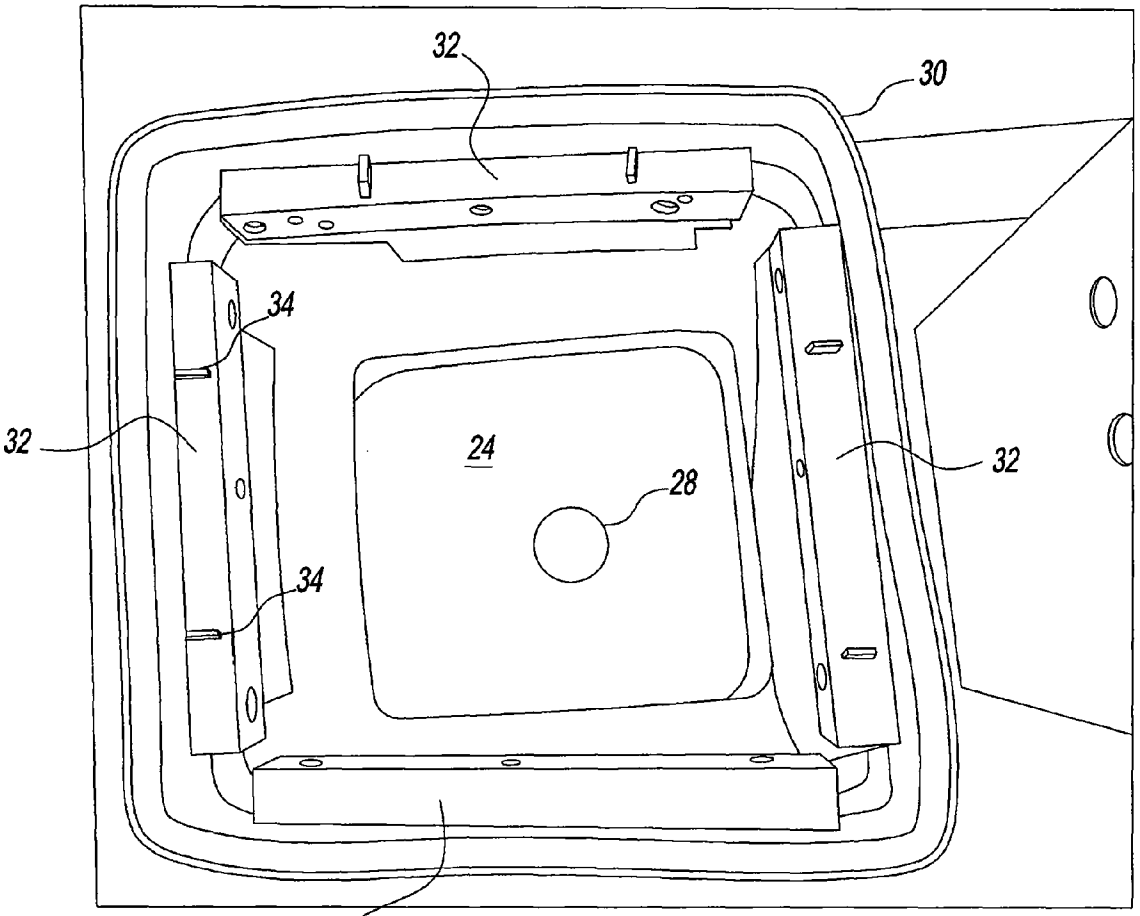
FIG. 3 shows a top view of a cooling module of the present disclosure.
Figure 4:
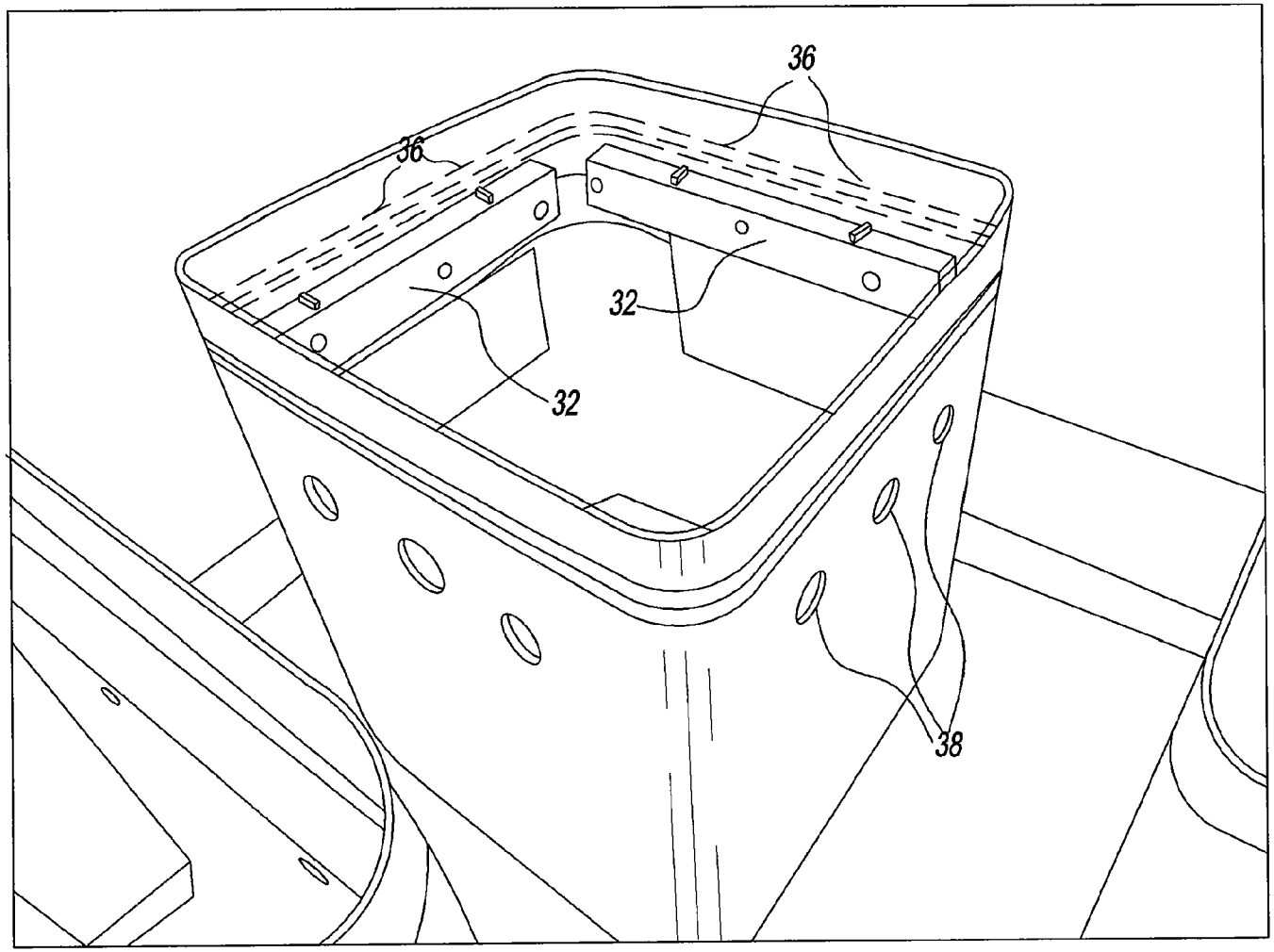
FIG. 4 shows a top, perspective view of the cooling module of FIG. 3.
Figure 5:
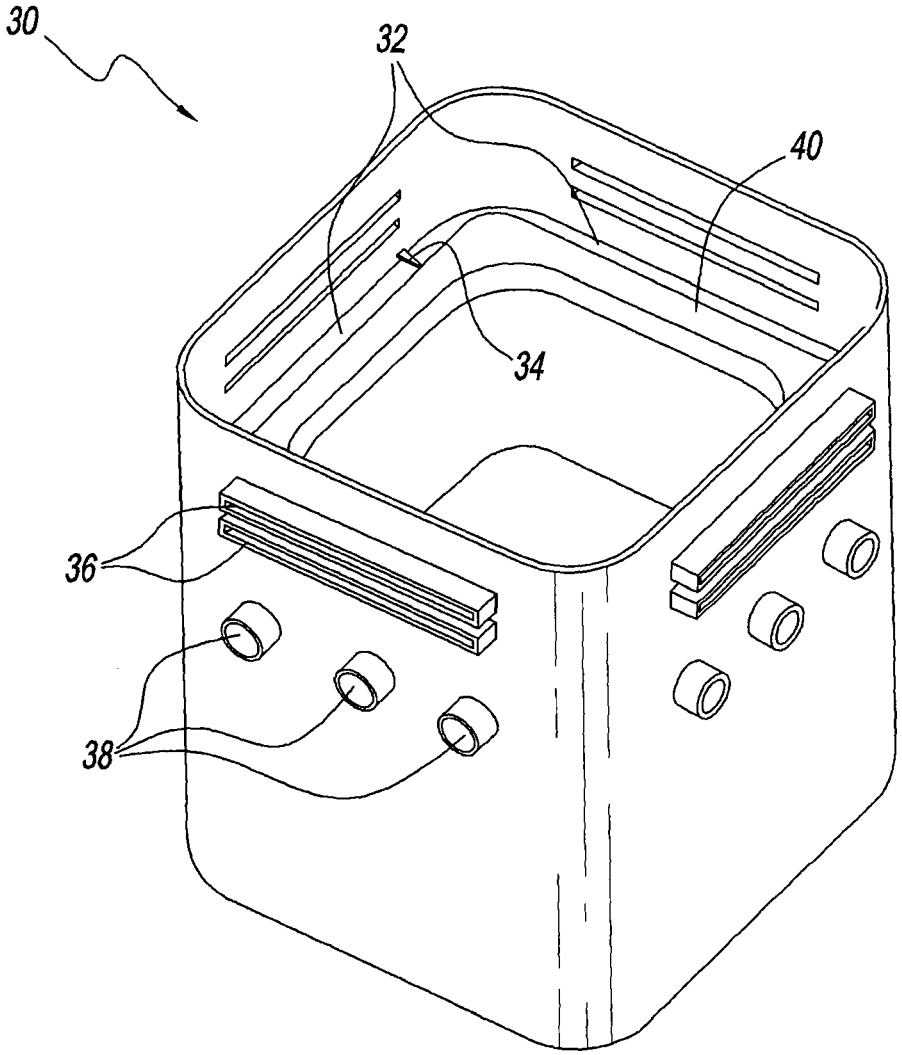
FIG. 5 shows a top, perspective view of the cooling module of FIG. 3, with a food pan placed therein.
Figure 6:
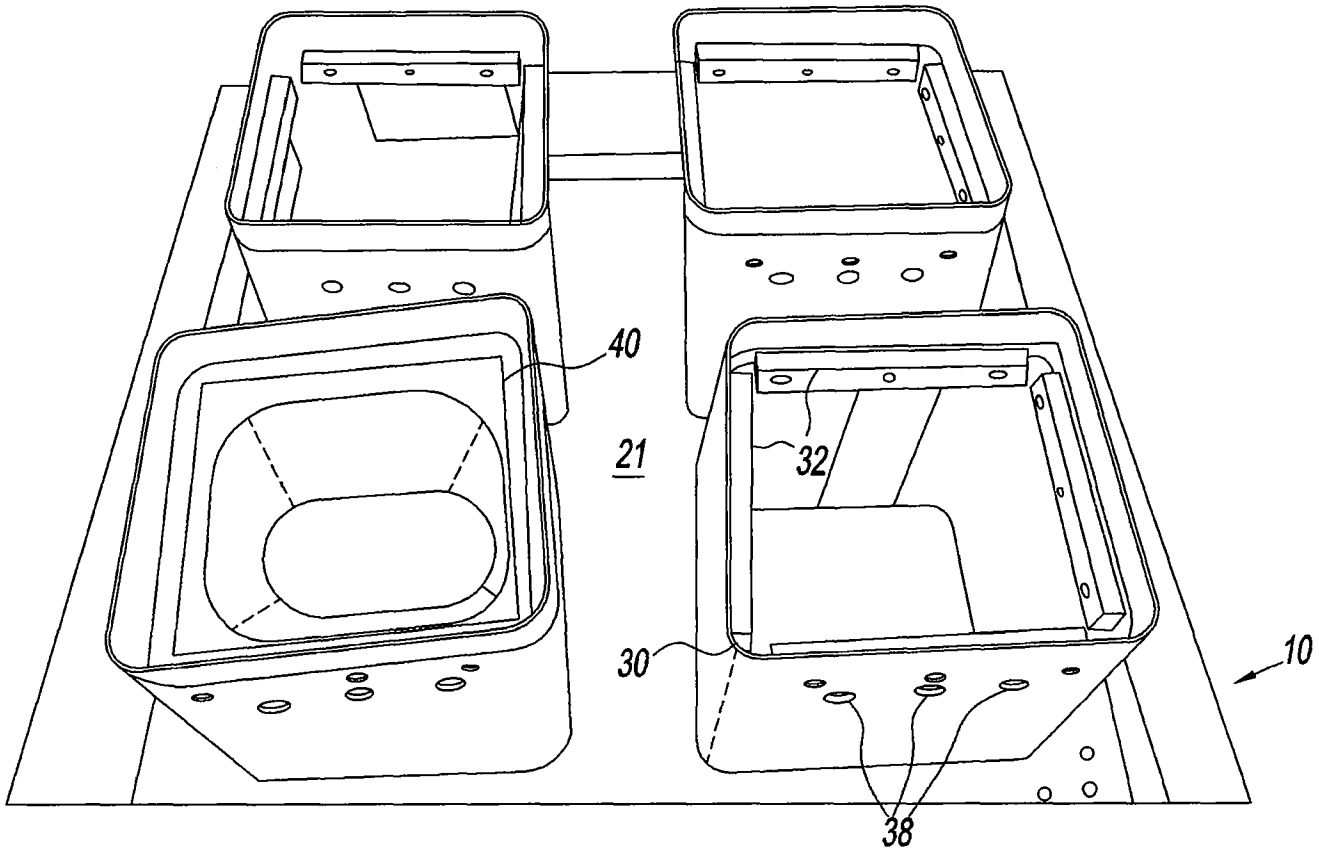
FIG. 6 shows a top, perspective view of the prep table of the present disclosure, showing multiple cooling modules placed part of the way into a divider bar, and one food pan.

Referring specifically to FIGS. 3 and 4, cooling modules 30 are shown in detail. Cooling modules 30 are single-walled structures with open bottoms, in which pans 40 are stored on support rails 32. Modules 30 have a plurality of narrow slits 36 along the top thereof, on at least one side. In the shown embodiment, there are two rows of narrow slits 36 on all four sides of module 30. In one embodiment, slits 36 can be about one-sixteenth of an inch (1/16") to three-thirty-seconds of an inch (3/32") wide. The width of slits 36 should be such that the right amount of cooled air is passed therethough to keep the surface of the food within pan 40 at the ideal temperature. The surface temperature of the food is one critical factor in preventing spoilage. Narrow slits 36 are advantageous in that the amount of cooled air passed over pan 40 can be controlled tightly, to achieve the desired amount of cooling without wasting too much cooled air and energy.

Pressurized air exiting vent 26 passes through slits 36 and over the surface of pan 40, in the manner discussed below. Support rails 32 are located at a distance below the upper lip of module 30, to allow for the placement of slits 36. In one embodiment, this distance is such that pan 40 is about one inch (1") below the upper surface of module 30. Slits 36 can be located anywhere within this distance between support rails 32 and the upper lip of module 30, for example at one-half inch below the upper lip of module 30 and above support rails 32.

Support rails 32 each have a number of spacers 34 thereon. Thus, when pan 40 sits on support rails 32, spacers 34 provide for a small gap between the lip of pan 40 and support rails 32. This allows for the air passing through slits 36 and over pan 40 to be passed through the gap, and out through the bottom of module 30. In one embodiment, spacers 34 can be metal rods having a diameter of about one tenth of an inch (0.1"), and the gap between pan 40 and support rails 32 would be this approximate size.

Modules 30 can optionally also have a number of side holes 38 therein. Side holes 38 are located on module 30 at a height that is below the upper surface of pan 40 when it is placed on support rails 32. Side holes 38 can have a diameter of about one half inch (½").

Modules 30 can be generally square or rectangular in shape, with or without rounded corners. The sides of modules 30 can be from six and one half (6.5) to twenty-one (21) inches long, or any subranges therebetween. Modules 30 can also be from six and one-half (6.5) to nine (9) inches deep, or any subranges therebetween. In one embodiment, modules 30 are square, with 6.7 inches to a side, and are 7.5 to 9 inches deep. Modules 30 should have the appropriate dimensions to fit standard sizes of food pans 40 in the manner described below. Standard pan sizes are one-sixth, one-third, one-half, or full-size. Modules 30 should also be deep enough to accommodate pans 40, the latter of which can be from four inches to six inches deep.

When prep table 10 is in use, modules 30 are placed in openings 23 of divider 21, so that the top of modules 30 are flush with the surface of divider 21. The bottom of module 30 contacts bottom surface 24 of chamber 20. Module 30 is then sealed to divider 21 and bottom surface 24, which allows for the pressurization of chamber 20 to the desired level. Food pans 40 are placed in module 30, as described above. As cooled air exits vent 26, it passes through slits 36, over the top of pan 40, thus cooling the food therein, through the gap between pan 40 and support rails 32, and out through bottom holes 28. Cooled air can also pass through side holes 38, cooling the sides of pan 40, and also out through the bottom of module 30 into bottom holes 28.

Thus, prep table 10 provides a streamlined, efficient way to cool products within pans 40. The fact that chamber 20 is pressurized means that ambient air has less of an adverse effect on the cooling of food products within pan 40, as the air does not stagnate over pan 40, but rather moves quickly. The placement of pans 40 below the surface of divider bar 21 also assists in insulating the food product from ambient air currents.

Module 30 can be sealed to divider bar 21 and bottom surface 24 of chamber 20 with adhesive tape. In another embodiment, module 30 is connected to divider bar 21 and/or bottom surface with an o-ring and cylinder that would fit around the upper or lower edges of module 30.

Module 30 may be made of an easily moldable material, one that is easily cleaned (e.g., dishwasher safe), and inexpensive. One suitable material is polycarbonate. Other components in prep table 10, such as chamber 20 and food pans 40, may be made of a material suitable for contact with food, such as plastic or stainless steel.

In the shown embodiment, divider bar 21 is configured for four cooling modules 30. The present disclosure contemplates other configurations, such as for six, eight, or nine cooling modules.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure.

What is claimed is:

1. A food preparation table, comprising:

a chamber having side walls, an open top end, a bottom surface, and a hole in said bottom surface;

a divider bar covering said open top end of said chamber and sealingly connected to said side walls of said chamber, wherein said divider bar comprises at least one aperture therein;

a pan cooling module having a walled structure, and which is open at a top end and open at a bottom end, wherein said pan cooling module is within said aperture of said divider bar; and a food pan within said pan cooling module, wherein said bottom end of said pan cooling module is sealingly connected to said bottom surface of said chamber, so that said bottom end of said pan cooling module covers said hole in said bottom surface of said chamber, and wherein said top end of said pan cooling module is sealingly connected to said divider bar.

2. The food preparation table of claim 1, further comprising an air vent within one of said side walls of said chamber, wherein air is introduced to said chamber through said air vent.

3. The food preparation table of claim 1, wherein said food pan is mounted in said pan cooling module so that a top surface of said food pan is below said top end of said pan cooling module.

4. The food preparation table of claim 3, wherein said pan cooling module has a plurality of support members connected to an interior of said walled structure, for supporting said food pan.

5. The food preparation table of claim 4, wherein said support members have offsets connected to a top surface thereof, so that said food pan rests on said offsets.

6. The food preparation table of claim 4, wherein said pan cooling module has a plurality of apertures in said walled structure, between said support members and said bottom end.

7. The food preparation table of claim 3, wherein said pan cooling module has a plurality of slits in said walled structure between said top end and said top end of said food pan.

8. The food preparation table of claim 1, wherein said top end of said pan cooling module is flush with a top surface of said divider bar.

9. The food preparation table of claim 1, comprising a plurality of said pan cooling modules and a plurality of said food pans, each of said plurality of pan cooling modules having one of said plurality of food pans associated therewith.

10. The food preparation table of claim 1, wherein said aperture in said divider bar is aligned with said hole in said bottom surface.

11. A method of cooling food in a food preparation table, the food preparation table comprising:

a chamber having an open top end and a hole in a bottom surface thereof;

a pan cooling module having a structure, and which is open at a top end and open at a bottom end, wherein said pan cooling module is within said chamber, and wherein said bottom end of said pan cooling module is sealingly connected to said bottom surface of said chamber, so that said bottom end of said pan cooling module covers said hole in said bottom surface of said chamber; and a food pan within said pan cooling module, the method comprising the steps of:

pressurizing said chamber by introducing cooled air thereto.

12. The method of claim 11, further comprising the step of passing said cooled air over a top surface of said food pan.

13. The method of claim 11, further comprising the step of passing said cooled air around a side of said food pan through openings in a side wall of said pan cooling module.

14. The method of claim 12 or claim 13, further comprising the step of passing said cooled air through said hole in said bottom surface of said chamber.

* * * * *